US008920197B2

(12) United States Patent
Tziviskos et al.

(10) Patent No.: US 8,920,197 B2
(45) Date of Patent: Dec. 30, 2014

(54) CONNECTOR RECEPTACLE WITH GROUND CONTACT HAVING SPLIT REAR EXTENSIONS

(75) Inventors: George Tziviskos, Cupertino, CA (US); Zheng Gao, San Jose, CA (US); Jason Minahan, San Jose, CA (US)

(73) Assignee: Apple Inc., Cupertino, CA (US)

( * ) Notice: Subject to any disclaimer, the term of this patent is extended or adjusted under 35 U.S.C. 154(b) by 219 days.

(21) Appl. No.: 13/419,904

(22) Filed: Mar. 14, 2012

(65) Prior Publication Data

US 2013/0244494 A1 Sep. 19, 2013

(51) Int. Cl.
*H01R 24/00* (2011.01)

(52) U.S. Cl.
USPC ..... 439/660

(58) Field of Classification Search
USPC ..... 439/660, 108, 489
See application file for complete search history.

(56) References Cited

U.S. PATENT DOCUMENTS

| | | | | |
|---|---|---|---|---|
| 5,376,909 | A | 12/1994 | Nelson et al. | |
| 6,431,906 | B1 | 8/2002 | Belopolsky | |
| 6,524,134 | B2 | 2/2003 | Flickinger et al. | |
| 6,945,824 | B1 * | 9/2005 | Li et al. | 439/660 |
| 7,018,242 | B2 | 3/2006 | Brown et al. | |
| 7,210,945 | B1 * | 5/2007 | Ying | 439/79 |
| 7,273,390 | B2 | 9/2007 | Iida et al. | |
| 7,559,805 | B1 * | 7/2009 | Yi et al. | 439/660 |
| 7,654,866 | B2 * | 2/2010 | He et al. | 439/607.01 |
| 7,699,663 | B1 | 4/2010 | Little et al. | |
| 7,722,407 | B2 * | 5/2010 | Momose | 439/638 |
| 7,727,026 | B2 * | 6/2010 | Qin et al. | 439/660 |
| 7,748,999 | B1 * | 7/2010 | Sun et al. | 439/79 |
| 7,794,284 | B1 * | 9/2010 | He et al. | 439/660 |
| 7,806,735 | B1 * | 10/2010 | Chen et al. | 439/676 |
| 7,850,465 | B1 | 12/2010 | Wan et al. | |
| 7,878,847 | B2 * | 2/2011 | He et al. | 439/541.5 |
| 7,959,450 | B1 * | 6/2011 | Wang et al. | 439/135 |
| 7,988,495 | B2 * | 8/2011 | Chung | 439/660 |

(Continued)

FOREIGN PATENT DOCUMENTS

CN 201355727 Y 12/2009

OTHER PUBLICATIONS

International Search Report and Written Opinion mailed on Jun. 6, 2013 for PCT Patent Application No. PCT/US2013/031686, 12 pages.

(Continued)

*Primary Examiner* — Neil Abrams
(74) *Attorney, Agent, or Firm* — Kilpatrick Townsend & Stockton LLP

(57) ABSTRACT

Connector receptacles that are simple to assemble, provide good shielding, and consume a reduced or limited amount of space inside a device enclosure. To simplify assembly, these receptacles may include a subassembly that is inserted into a hollow tongue. The subassembly may include a first number of contacts that are insert molded in a first overmold, as well as a second number of contacts that may be inserted into a second overmold. To improve ground shielding, one or more ground contacts at a front of the receptacle may be split to provide shielding in a back of the receptacle. The tongue may further include ground contacts on its edges and top. Edge ground contacts may be inserted into the hollow tongue either separately or with the subassembly. Openings in the hollow tongue may expose portions of the edge ground contacts for grounding.

30 Claims, 21 Drawing Sheets

(56) References Cited

U.S. PATENT DOCUMENTS

| | | | | |
|---|---|---|---|---|
| 8,021,188 | B1 * | 9/2011 | Ma et al. | 439/607.55 |
| 8,025,532 | B2 | 9/2011 | Nagata et al. | |
| 8,033,868 | B2 * | 10/2011 | Wang et al. | 439/660 |
| 8,052,431 | B1 * | 11/2011 | He et al. | 439/78 |
| 8,079,854 | B2 * | 12/2011 | He et al. | 439/108 |
| 8,147,276 | B2 * | 4/2012 | Wang et al. | 439/660 |
| 8,162,671 | B2 * | 4/2012 | Matsubara et al. | 439/60 |
| 8,215,989 | B2 | 7/2012 | Tamm et al. | |
| 8,303,329 | B2 | 11/2012 | Wu | |
| 8,408,940 | B2 * | 4/2013 | Chang | 439/607.01 |
| 8,419,473 | B1 * | 4/2013 | Lan et al. | 439/607.17 |
| 8,439,576 | B2 | 5/2013 | Hsiao et al. | |
| 8,439,691 | B1 * | 5/2013 | Lan et al. | 439/79 |
| 8,475,218 | B2 | 7/2013 | Zheng et al. | |
| 8,480,435 | B2 * | 7/2013 | Hsiao et al. | 439/660 |
| 8,480,436 | B2 * | 7/2013 | Chang | 439/660 |
| 8,545,273 | B1 | 10/2013 | Chen | |
| 8,574,011 | B2 * | 11/2013 | Shih | 439/660 |
| 8,602,825 | B2 * | 12/2013 | Chen | 439/660 |
| 8,641,454 | B2 * | 2/2014 | Chen et al. | 439/660 |
| 8,690,608 | B2 * | 4/2014 | Naito et al. | 439/660 |
| 8,702,452 | B2 * | 4/2014 | Tai et al. | 439/660 |
| 8,721,361 | B2 * | 5/2014 | Wu | 439/497 |
| 8,764,492 | B2 * | 7/2014 | Chiang | 439/676 |
| 2003/0194908 | A1 | 10/2003 | Brown et al. | |
| 2005/0113889 | A1 | 5/2005 | Jimenez et al. | |
| 2005/0181643 | A1 | 8/2005 | Brower et al. | |
| 2005/0255745 | A1 | 11/2005 | Walker et al. | |
| 2006/0091006 | A1 | 5/2006 | Wang et al. | |
| 2008/0311801 | A1 | 12/2008 | Chen et al. | |
| 2010/0055986 | A1 | 3/2010 | Wang et al. | |
| 2010/0227509 | A1 | 9/2010 | He et al. | |
| 2010/0253538 | A1 | 10/2010 | Smith | |
| 2011/0021043 | A1 | 1/2011 | Lee | |
| 2011/0040246 | A1 | 2/2011 | Galasso | |
| 2011/0081022 | A1 | 4/2011 | Tamm et al. | |
| 2011/0256764 | A1 | 10/2011 | Wu | |
| 2011/0269322 | A1 | 11/2011 | He et al. | |
| 2011/0269341 | A1 | 11/2011 | He et al. | |
| 2011/0294339 | A1 | 12/2011 | Wu | |
| 2012/0020624 | A1 | 1/2012 | Liao et al. | |
| 2012/0077390 | A1 * | 3/2012 | Tsai | 439/660 |
| 2012/0083164 | A1 | 4/2012 | Gao et al. | |
| 2013/0040470 | A1 | 2/2013 | Gao et al. | |
| 2013/0288537 | A1 * | 10/2013 | Simmel et al. | 439/660 |
| 2013/0316592 | A1 * | 11/2013 | Yu et al. | 439/660 |
| 2013/0329324 | A1 | 12/2013 | Tziviskos et al. | |
| 2014/0045352 | A1 * | 2/2014 | Weber et al. | 439/78 |

OTHER PUBLICATIONS

Non-Final Office Action mailed on May 1, 2014 for U.S. Appl. No. 13/492,813, 12 pages.

* cited by examiner

CONNECTOR RECEPTACLE WITH GROUND CONTACT HAVING SPLIT REAR EXTENSIONS

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various cable assemblies. These cable assemblies may include connector inserts, or plugs, on one or more ends of a cable.

The connector inserts may plug into connector receptacles on electronic devices, thereby forming one or more conductive paths for signals and power.

The connector receptacles may be formed of housings that typically at least partially surround and provide mechanical support for contacts. These contacts may be arranged to mate with corresponding contacts on the connector inserts or plugs to form portions of electrical paths between devices.

The numbers of these receptacles that are manufactured for some electronic devices can be very large. Accordingly, it may be desirable to provide connector receptacles that are simple to assemble and manufacture.

As a further complication, the data rates of some signals conveyed by these connector receptacles have increased over time. To be able to handle these signals, it may be desirable that the connector receptacles do not degrade signal quality significantly. An important aspect of providing good signal quality is to provide a good ground path and shielding for the connector receptacle and corresponding connector insert. Accordingly, it may be desirable to provide connector receptacles that provide a good ground shielding. It may also be desirable to provide connector receptacles that are arranged to consume a reduced or limited amount of space in a device enclosure.

Thus, what is needed are connector receptacles that are that may be simple to assemble, provide good shielding, and consume a reduced or limited amount of space inside a device enclosure.

SUMMARY

Accordingly, embodiments of the present invention may provide connector receptacles that are simple to assemble, provide good shielding, and consume a reduced or limited amount of space inside a device enclosure.

An illustrative embodiment of the present invention may simplify assembly by providing a connector receptacle having a number of contacts in a subassembly. The subassembly may include a first number of contacts that are insert-molded in an overmold. A second number of contacts may be added to the overmold. The subassembly may be inserted into a hollow tongue portion of the connector receptacle. The hollow tongue may protect portions of the first and second numbers of contacts.

Another illustrative embodiment of the present invention may simplify assembly by providing a connector receptacle having a number of contacts in a subassembly. The subassembly may include a first number of contacts that are insert-molded in a first overmold. A second number of contacts may be held together using a second overmold. The first overmold and the second overmold may be attached to each other. In a specific embodiment of the present invention, this may be done using pins and holes located on either or both of the overmolds. The subassembly may be inserted into a hollow tongue portion of the connector receptacle. The hollow tongue may protect portions of the first and second numbers of contacts.

Another illustrative embodiment of the present invention may improve signal quality by providing a connector receptacle having a good ground shielding. In various embodiments of the present invention, one or more ground contacts may be split and routed such that one ground contact at a front or mating portion of a connector receptacle may provide ground contacts on either side of one or more signal contacts at a back of the connector receptacle. In a specific embodiment of the present invention, a single ground contact at a front of a connector receptacle is split in two at the back of the connector receptacle. A differential pair is then surrounded on each side by a portion of the split contact, thereby shielding the differential pair and improving signal quality.

Another illustrative embodiment of the present invention may improve signal quality by providing a connector receptacle having a good ground connection. In various embodiments of the present invention, ground contacts may be located on a tongue of the connector receptacle. In a specific embodiment of the present invention, ground contacts may be located on sides of a tongue. Contacts may be further included on a top of the tongue as well.

Another illustrative embodiment of the present invention may reduce the space consumed in a device enclosure by providing a number of contacts having through-hole contacts at one end. Having through-hole contacts may reduce the space consumed as compared to other contacts, such as surface mount contacts. To further reduce space, these through-hole contacts may be arranged substantially in a line.

Embodiments of the present invention may be used to improve various connector receptacles, such as those compatible with the various Universal Serial Bus interfaces and standards, including USB, USB2, and USB3, as well as High-Definition Multimedia Interface (HDMI), Digital Visual Interface (DVI), power, Ethernet, DisplayPort, Thunderbolt, and other types of interfaces and standards. These connector receptacles may be utilized in many types of devices, such as portable computing devices, tablet, desktop, and all-in-one computers, cell, smart, and media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
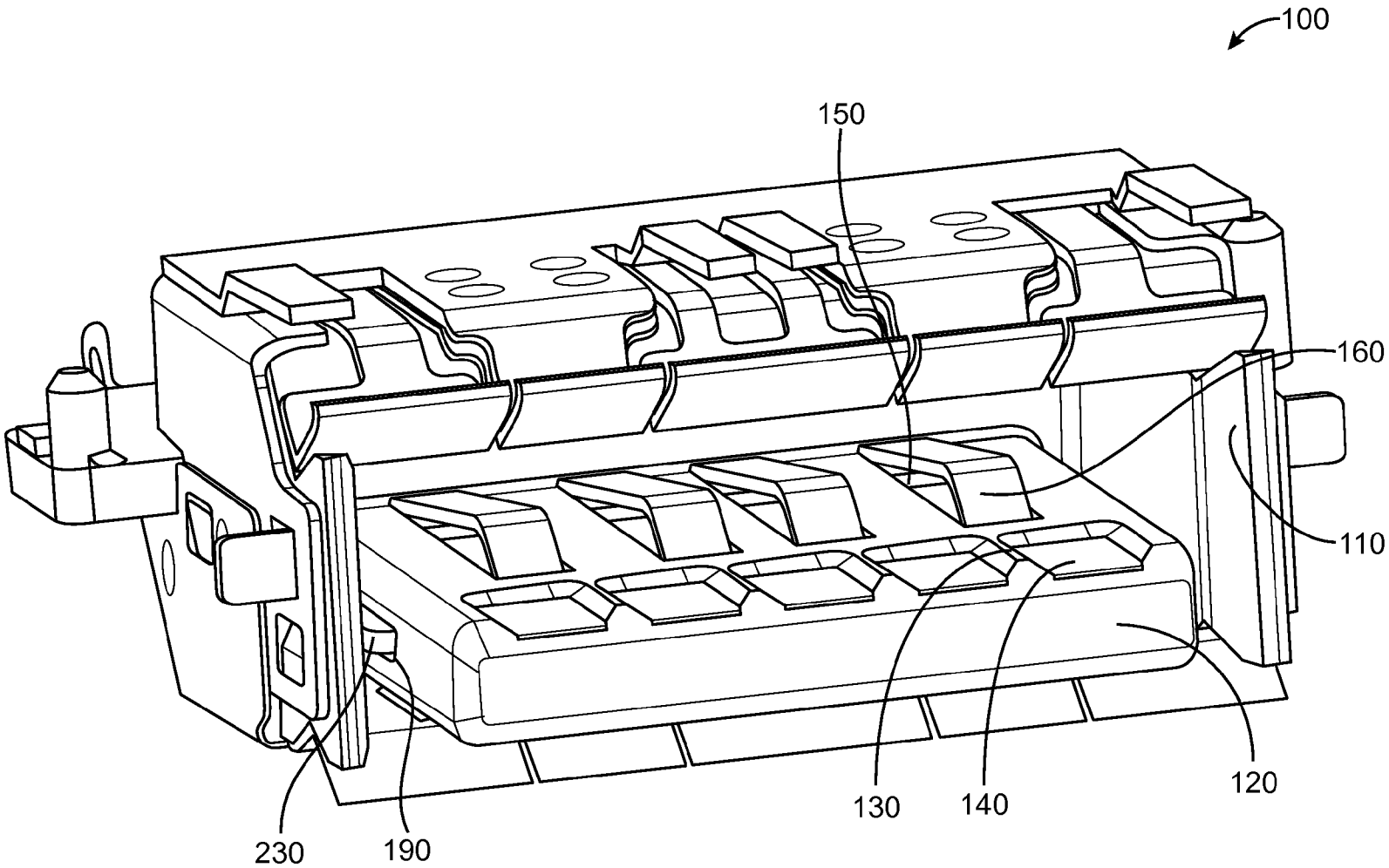
FIG. 1 illustrates a connector receptacle according to an embodiment of the present invention.

FIG. 1 illustrates a connector receptacle according to an embodiment of the present invention. This figure, as with the other included figures, is shown for illustrative purposes and does not limit either the possible embodiments of the present invention or the claims.

Connector receptacle 100 may include housing 110 having tongue 120. Tongue 120 may include a first number of openings 130 for a second number of contacts 140. Tongue 120 may further include a second number of openings 150 for a second number of contacts 160. Tongue 120 may further include side ground contacts 230 at openings 190.

In a specific embodiment of the present invention, connector receptacle 100 may be a USB3 connector. In this example, contacts 160 may be legacy USB contacts, while contacts 140 may be additional contacts added for USB3 compliance.

Figure 2:
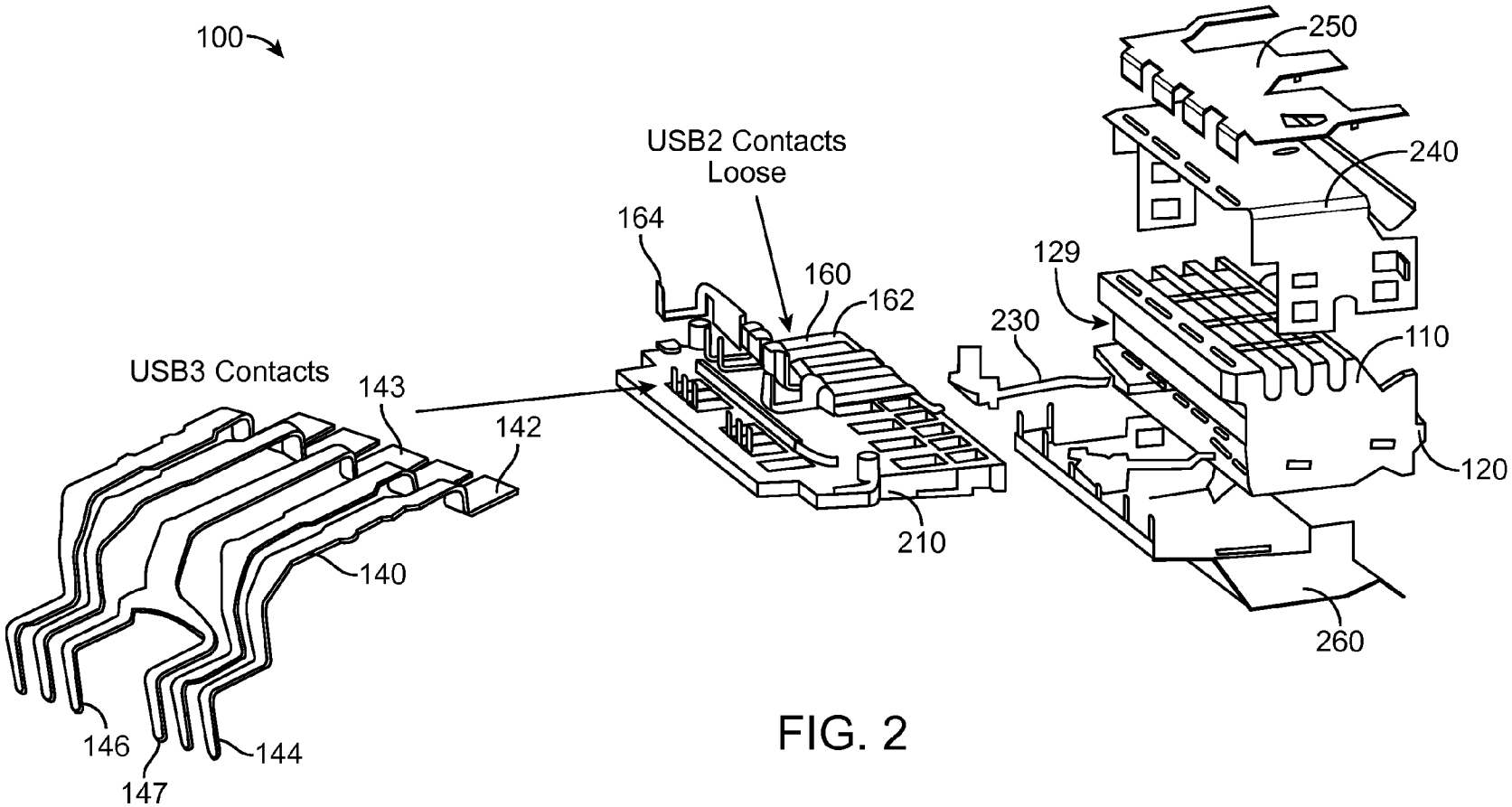
FIG. 2 illustrates an exploded view of a connector receptacle according to an embodiment of the present invention.

FIG. 2 illustrates an exploded view of a connector receptacle according to an embodiment of the present invention. Again, embodiments of the present invention may provide a simple to assemble connector receptacle by providing a subassembly that may be inserted into a hollow tongue of the connector receptacle. Specifically, a subassembly for connector receptacle 100 may include a first number of contacts 140 held together by overmold 210. A second number of contacts 160 may be placed on overmold 210. The completed subassembly including overmold 210 and its associated contacts may be inserted into tongue 120 of housing 110. Specifically, tongue 120 may be hollow such that it may accept overmold 210 and its contacts. Ground contacts 330 may be inserted either with the subassembly or separately into tongue 120. A shield may be formed of shield pieces 240, 250, and 260.

In a specific embodiment of the present invention, connector receptacle 100 may be assembled by receiving a first number of contacts 140. These contacts may include a contacting portion 142 and a through-hole contacting portion 144 at an opposite end. One of these contacts, in this example center contact 143, may have two through-hole contacting portions 146 and 147. The first number of contacts may be overmolded by piece 210 by using injection molding or other technique. Again, contacts 160 may be added to complete the subassembly. Contacts 160 may include a contacting portion 162, and a through-hole contacting portion 164 at an opposite end. After contacts 160 are added, through-hole contacting portions 164, 144, 146, and 147, may be arranged substantially in a line. Again, the completed subassembly and ground contacts 230 may be inserted into hollow tongue 120 through rear opening 129 in housing 110. Tongue openings 130 and 150 may be used to expose portions of contacts 140 and 160, as shown in FIG. 1. A top shield piece 260 and bottom pieces 240 and 250 may be added for shielding, grounding, and mechanical stability.

Figure 3:
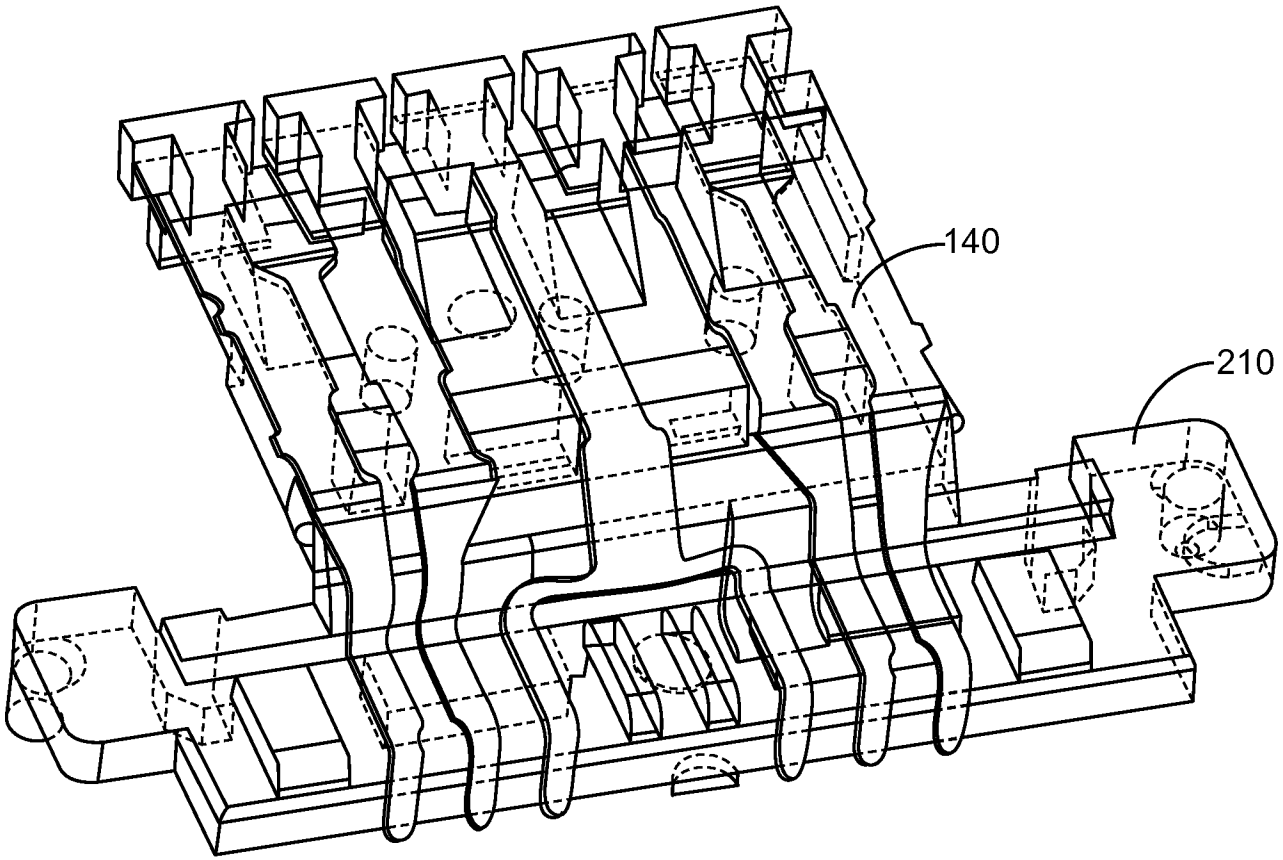
FIG. 3 illustrates a portion of a subassembly for a connector receptacle according to an embodiment of the present invention.

FIG. 3 illustrates a portion of a subassembly for a connector receptacle according to an embodiment of the present invention. This portion may include contacts 140, which may be located in overmold 210. Overmold 210 may be formed by injection molding or other appropriate technique.

Figure 4:
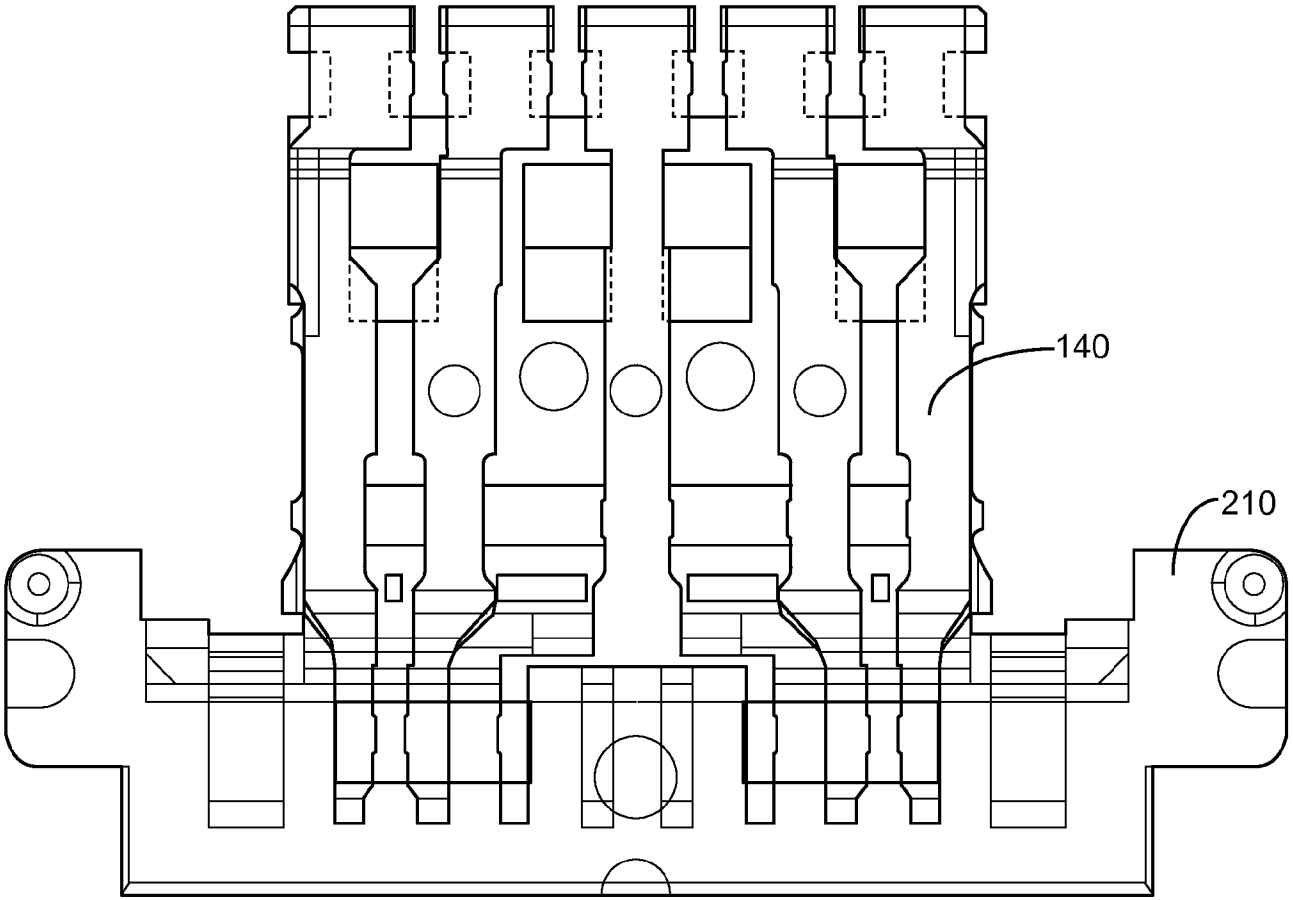
FIG. 4 illustrates another view of a portion of a subassembly for a connector receptacle according to an embodiment of the present invention.

FIG. 4 illustrates another view of a portion of a subassembly for a connector receptacle according to an embodiment of the present invention. Again, this portion may include contacts 140, which may be located in overmold 210.

Figure 5:
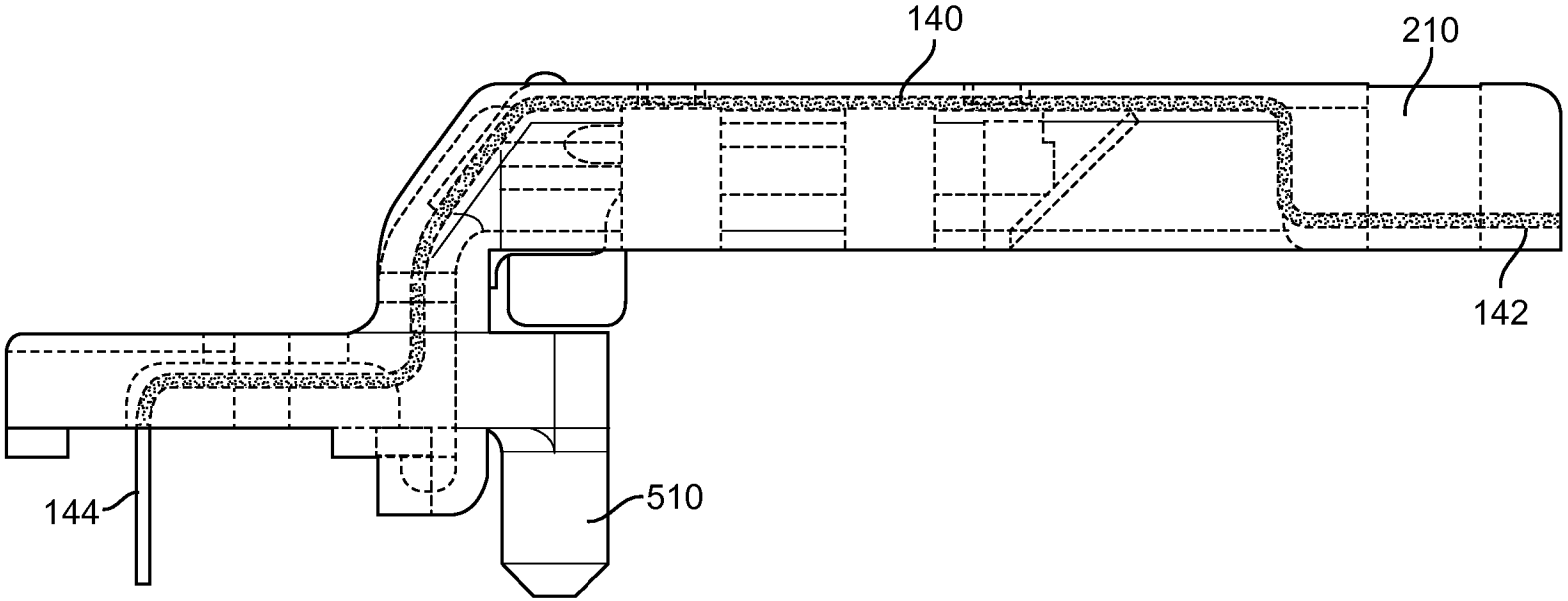
FIG. 5 illustrates a side view of a portion of a subassembly for a connector receptacle according to an embodiment of the present invention.

FIG. 5 illustrates a side view of a portion of a subassembly for a connector receptacle according to an embodiment of the present invention. Contacts 140 may be located in overmold 210. Contacts 140 may include a contacting portions 142 and through-hole contacting portions 144 at an opposite end. The through-hole contacting portions may be inserted and soldered to a flexible circuit board, printed circuit board, or other appropriate substrate. Overmold 210 may include post 510, which made be inserted into this or other flexible circuit board, printed circuit board or other appropriate substrate for mechanical stability.

Again, a second plurality of contacts may be added to this portion of the subassembly. Side ground contacts may also be added or inserted into tongue 120 separately. An example is shown in the following figure.

Figure 6:
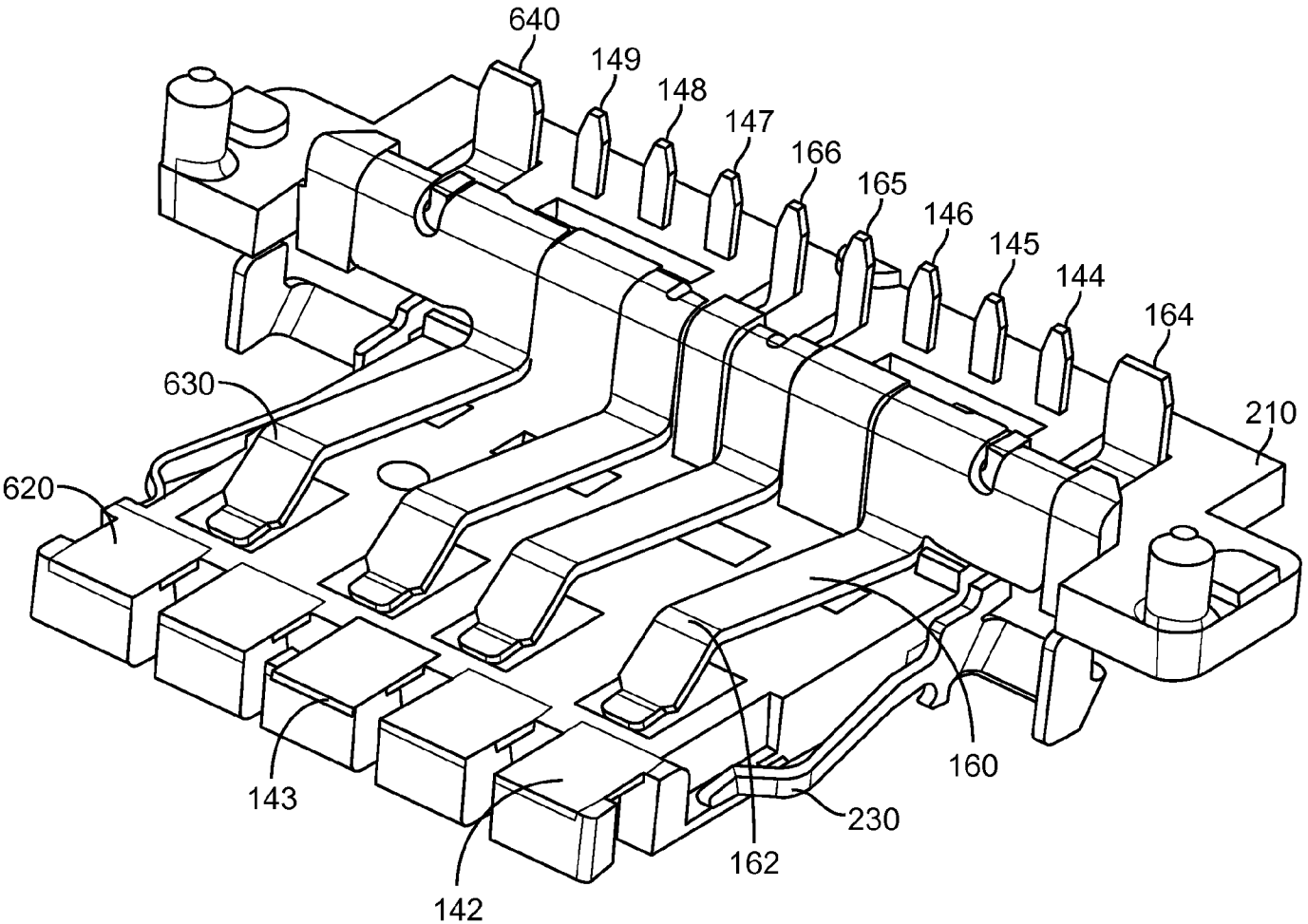
FIG. 6 illustrates a subassembly for a connector receptacle according to an embodiment of the present invention.

FIG. 6 illustrates a subassembly for a connector receptacle according to an embodiment of the present invention. The subassembly may include a first number of contacts on a contacting portions 142 and through-hole contacting portions 144, 146, and 147. The first number of contacts may be located in overmold 210. A second number of contacts 160 may be added. Side ground contacts 230 may further be added, or may be added to the connector receptacle separately a different time.

Again, embodiments of the present invention may provide USB3 connector receptacles. In other embodiments of the present invention, other connector receptacles that may be compliant with the other interfaces or standards may be provided. In this specific example, the connector receptacle may be compliant with USB3. In that situation, the first number of contacts, beginning with contact 620, may be used to convey a first differential pair, a first ground, and a second differential pair. The second number of contacts, beginning with contact 630, may be used to convey a second ground, a third differential pair, and a positive power supply.

In this specific example, a first ground, 143, may be split such as two through-hole contacting portions 146 and 147. As illustrated, these two through-hole contacting portions are located on each side of the through-hole contacting portions 165 and 166 for the third differential pair. In this way, ground contact 143 provides ground shielding for the third differential pair. Specifically, beginning with through-hole contacting portion 640, the through-hole contacting portions provide, in order, contacting portions for a second ground, the first differential pair, the first ground, the third differential pair, the first ground, a second differential pair, and a positive power supply. It should be noted the positive power supply is low impedance AC path, and thus may appear as a ground for shielding purposes.

Accordingly, the through-hole contacting portion 640 of the second ground and the through-hole contacting portion 147 of the first ground act as a shield for the through-hole contacting portions 148 and 149 of the first differential pair. Similarly, the through-hole contacting portion 164 of the power supply contact and through-hole contacting portion 146 of the ground contact provide low impedance shielding for a second differential pair through-hole contacting portions 144 and 145.

Figure 7:
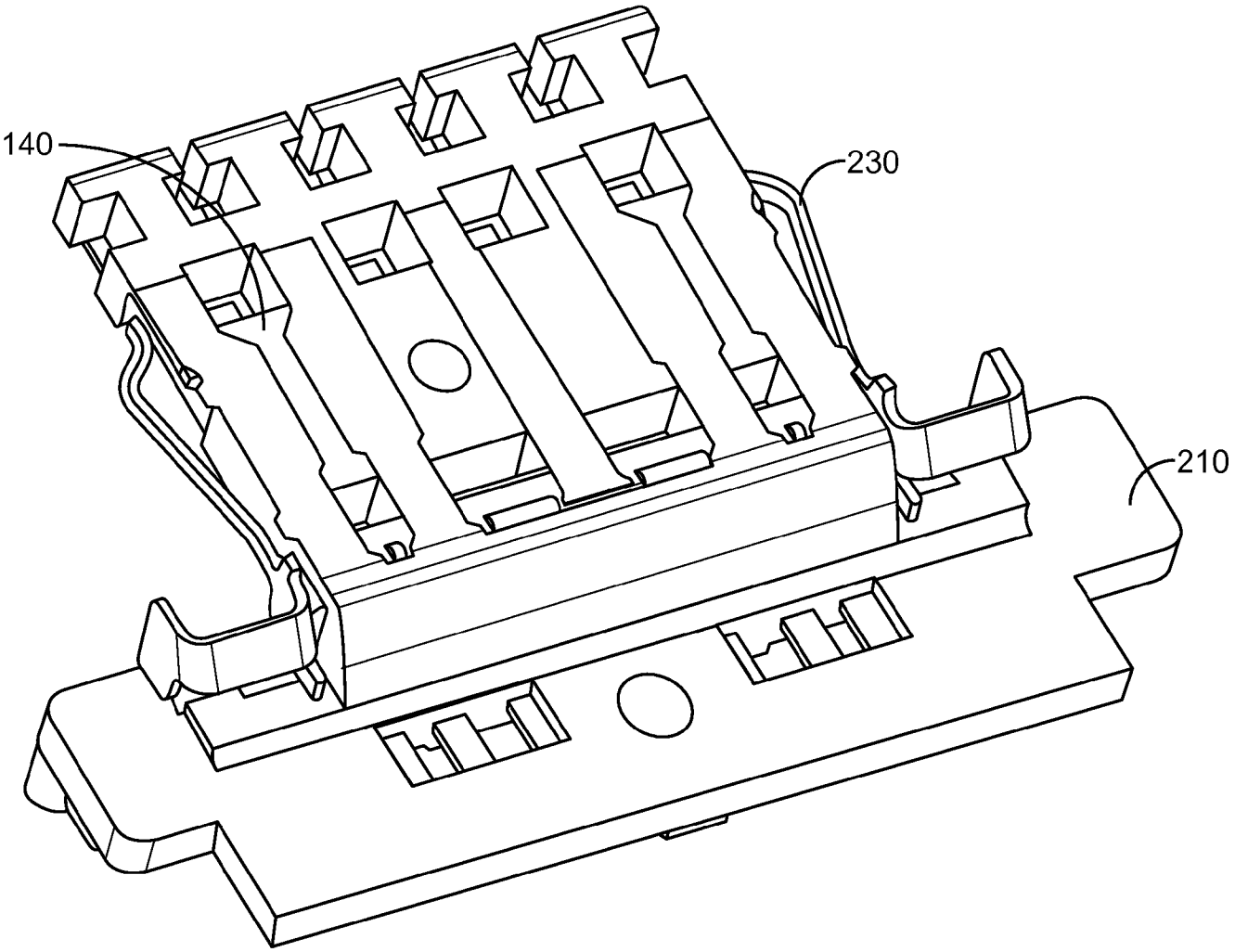
FIG. 7 illustrates another view of a subassembly according to embodiments of the present invention.

FIG. 7 illustrates another view of a subassembly according to embodiments of the present invention. As before, contacts 140 may be located in overmold 210. Side ground contacts 230 may be added at this or other time during the assembly. Again, this subassembly may be inserted into a hollow tongue 120 in housing 110. An example is shown in the following figure.

Figure 8:
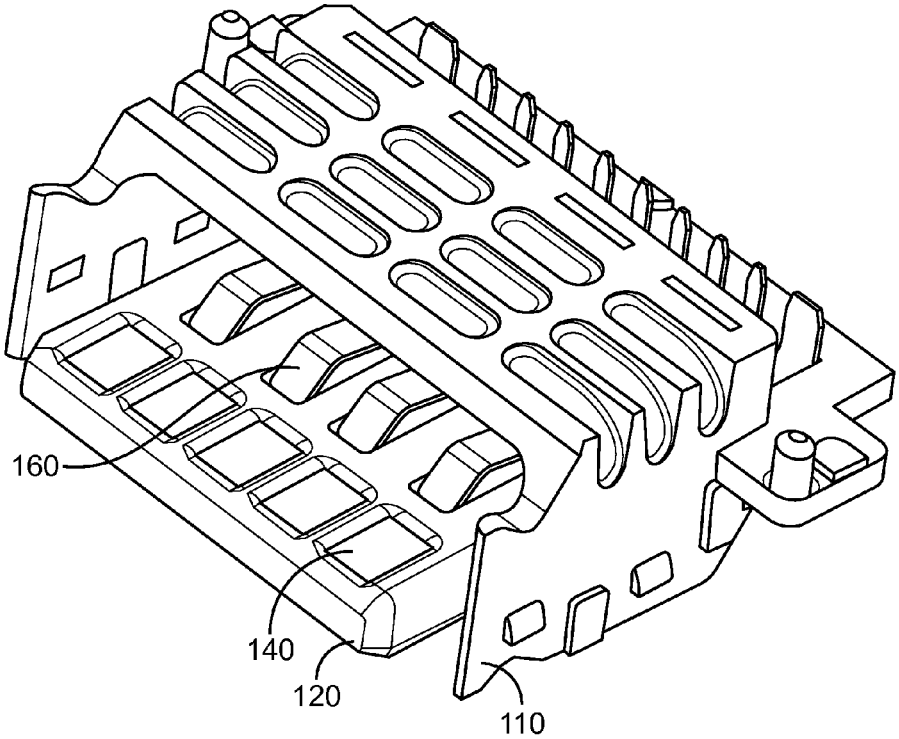
FIG. 8 illustrates a subassembly and housing of a connector receptacle according to an embodiment of the present invention.

FIG. 8 illustrates a subassembly and housing of a connector receptacle according to an embodiment of the present invention. This figure includes housing 110 having a tongue 120. Tongue 120 may be hollow to accept a subassembly including contacts 140 and 160.

Figure 9:
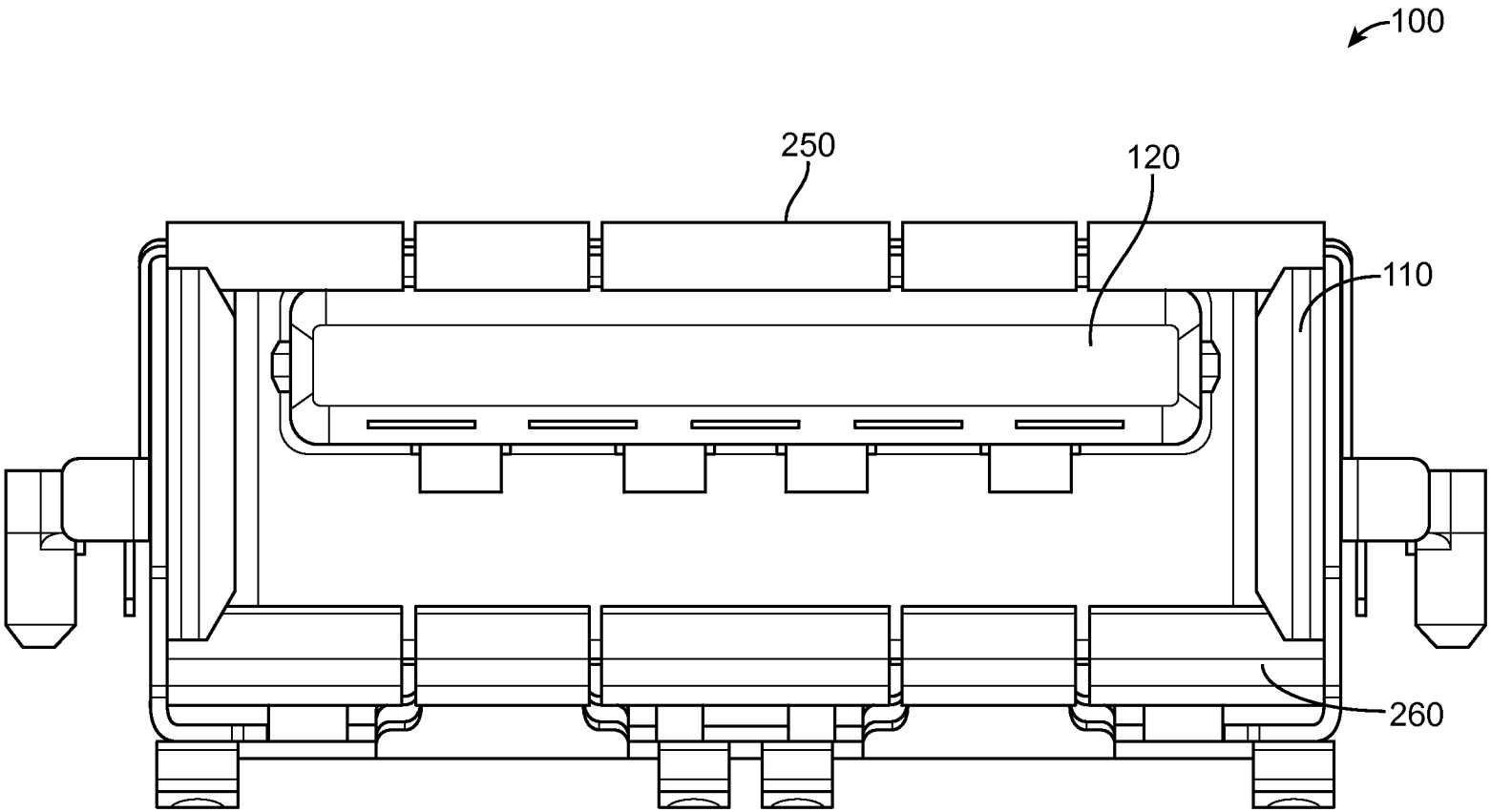
FIG. 9 illustrates a front view of a connector receptacle according to an embodiment of the present invention.

FIG. 9 illustrates a front view of a connector receptacle according to an embodiment of the present invention. Connector receptacle 100 may include housing 110 and tongue 120.

Connector receptacle 100 may also include shield portions 250 and 260. Shield portions 250 and 260 may be grounded to provide shielding and mechanical retention for an insert once the insert is inserted into connector receptacle 100.

Figure 10:
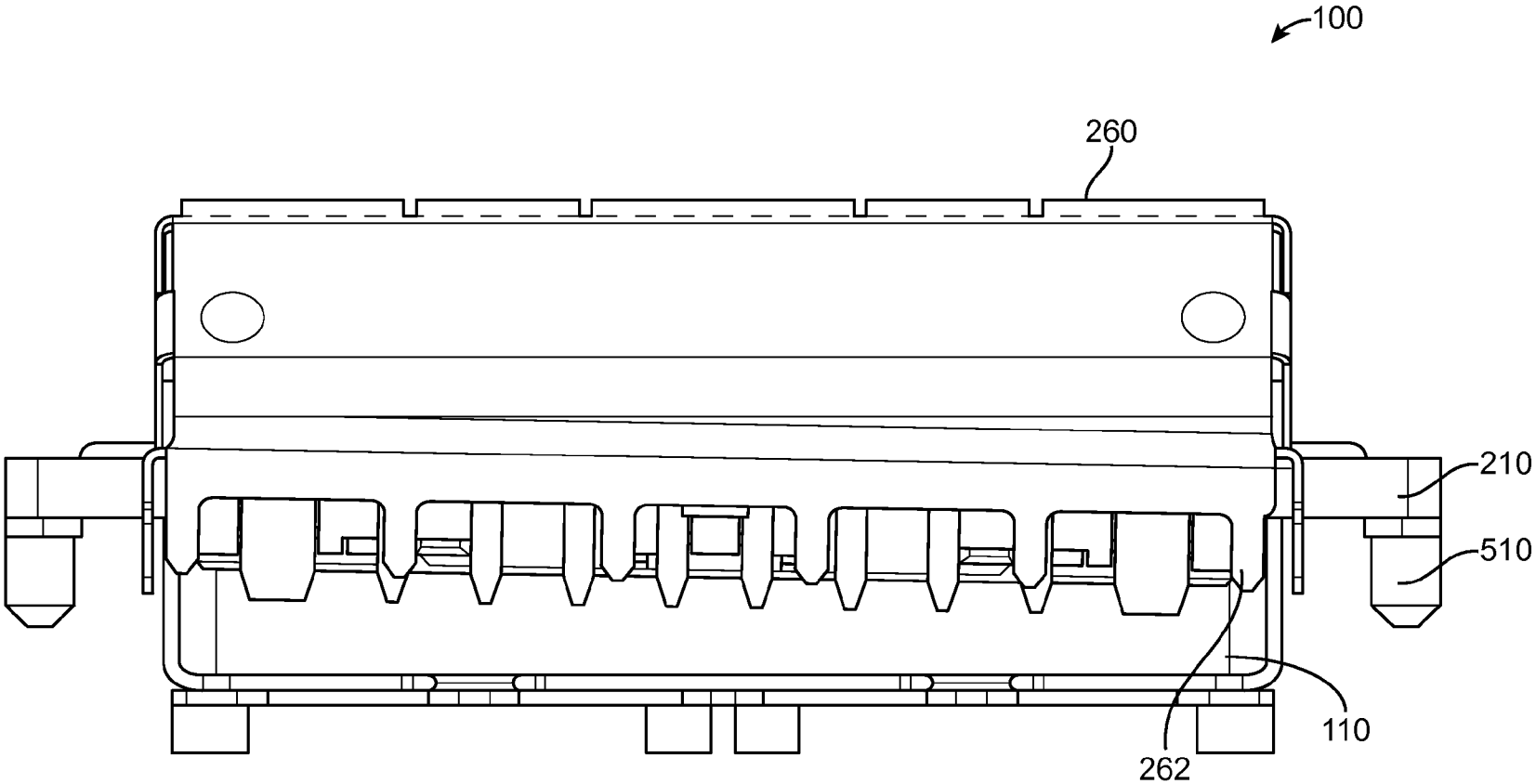
FIG. 10 illustrates a back side of a connector receptacle according to an embodiment of the present invention.

FIG. 10 illustrates a back side of a connector receptacle according to an embodiment of the present invention. Connector receptacle 100 may include housing 110. The subassembly portion 210 including post 510 may be used for mechanical stability. Shield 260 may include tabs 262, which may be soldered to a flexible circuit board, printed circuit board, or other appropriate substrate for grounding and mechanical stability.

Again, it may be desirable that connector receptacles according to an embodiment of the present invention consume a reduced amount of space inside a device enclosure. This in turn may allow a device to be smaller, or to include more functionality. Accordingly, embodiments of the present invention may include contacts having through-hole contacting portions. This in turn may save area, or board space, or both, as compared to surface mount contacts. An example is shown in the following figure.

Figure 11:
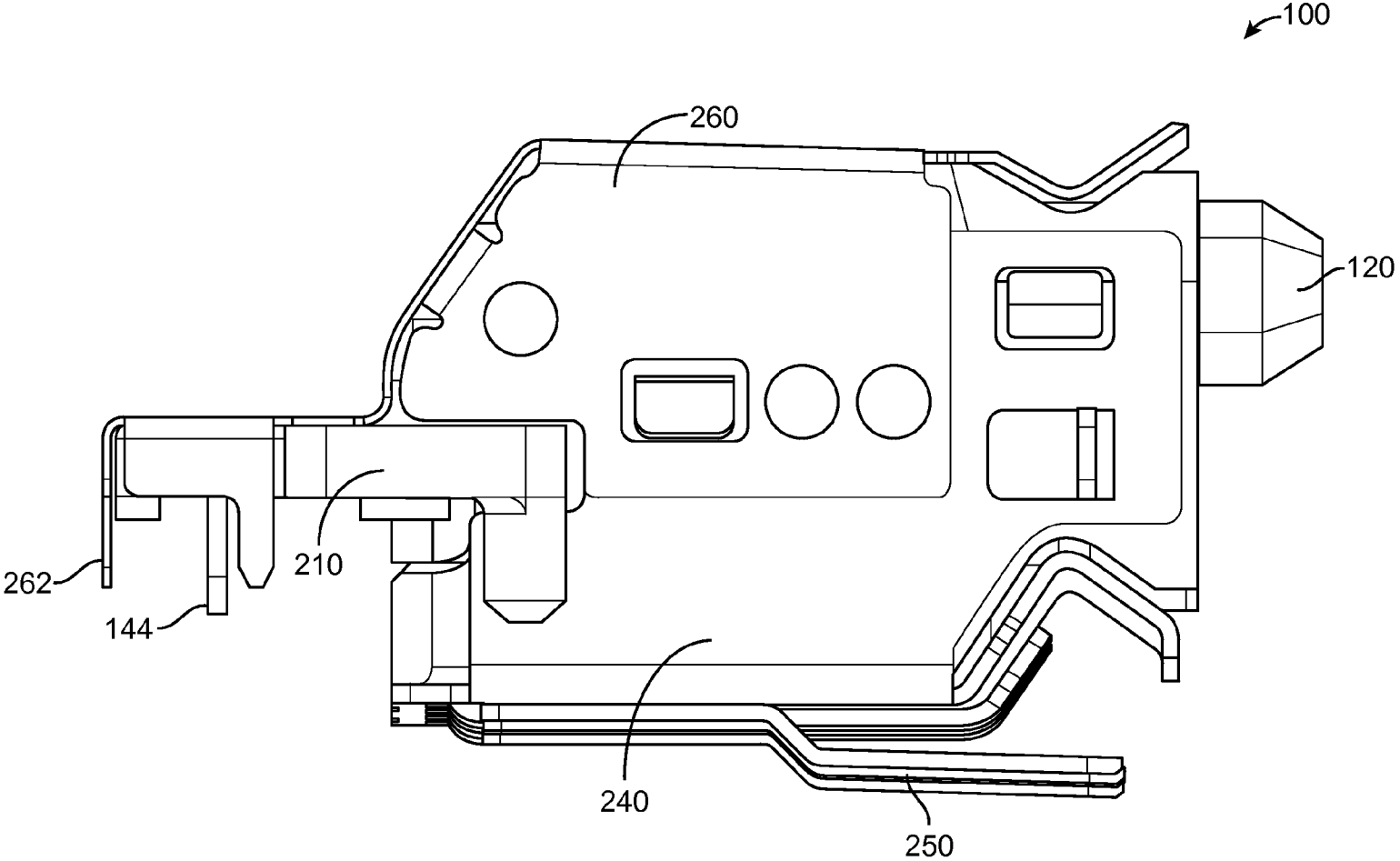
FIG. 11 illustrates a side view of a connector receptacle according to an embodiment of the present invention.

FIG. 11 illustrates a side view of a connector receptacle according to an embodiment of the present invention. Connector receptacle 100 includes subassembly 210 inserted into tongue 120. Connector receptacle 100 may be shielded by a top shield piece 260 and a bottom shield piece 240. A bottom shield piece 250 may be attached to bottom shield piece 240. Top shield piece 260 may include tabs 262, which may be soldered or otherwise connected to a flexible circuit board, printed circuit board, or other appropriate substrate. Similarly, contacts 144 may be attached to traces, ground, or power planes on the same or different substrate.

In other embodiments of the present invention, other types of subassemblies may be used. For example, instead of a single overmold, multiple overmolds may be employed. This may provide for a thinner overall structure. Also, to reduce connector thickness, a top or bottom portion may be removed. In such a situation, grounding or retention features on a top or bottom may be removed. In various embodiments of the present invention, other ground contacts and retention features may be employed to compensate. For example, in a specific embodiment of the present invention, a top portion of a housing and shielding may be removed, and replaced with ground contacts on a top of a tongue of the connector receptacle. An example is shown in the following figures.

Figure 12:
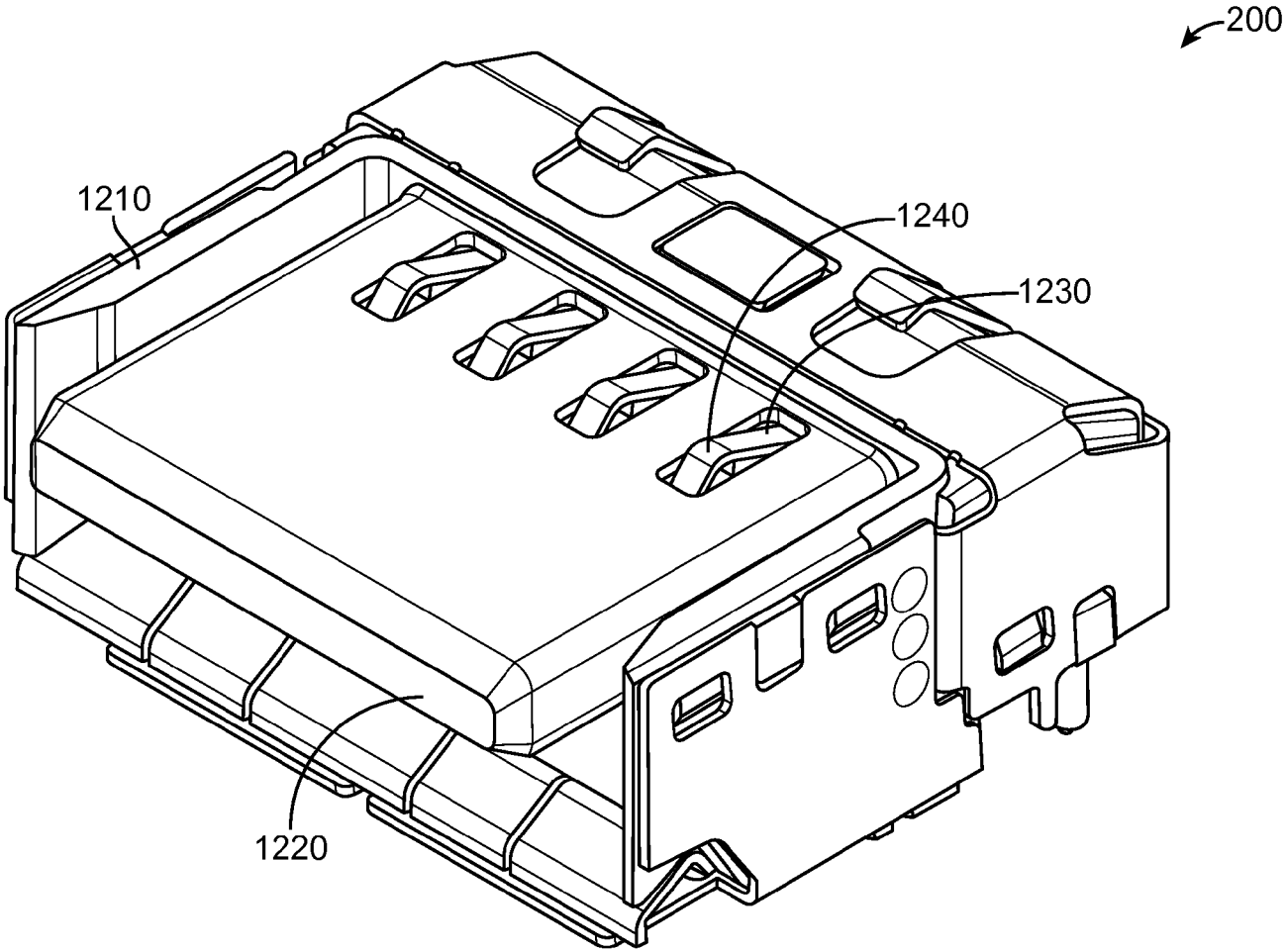
FIG. 12 illustrates a connector receptacle according to an embodiment of the present invention.

FIG. 12 illustrates a connector receptacle according to an embodiment of the present invention. Connector receptacle 1200 may include housing 1210 having tongue 1220. A top of housing 1210 may be removed. The removal of the shielding and mechanical retention features may be compensated for by the use of ground contacts 1240. Ground contacts 1240 may be exposed through openings 1230 in a top side of tongue 1220.

Figure 13:
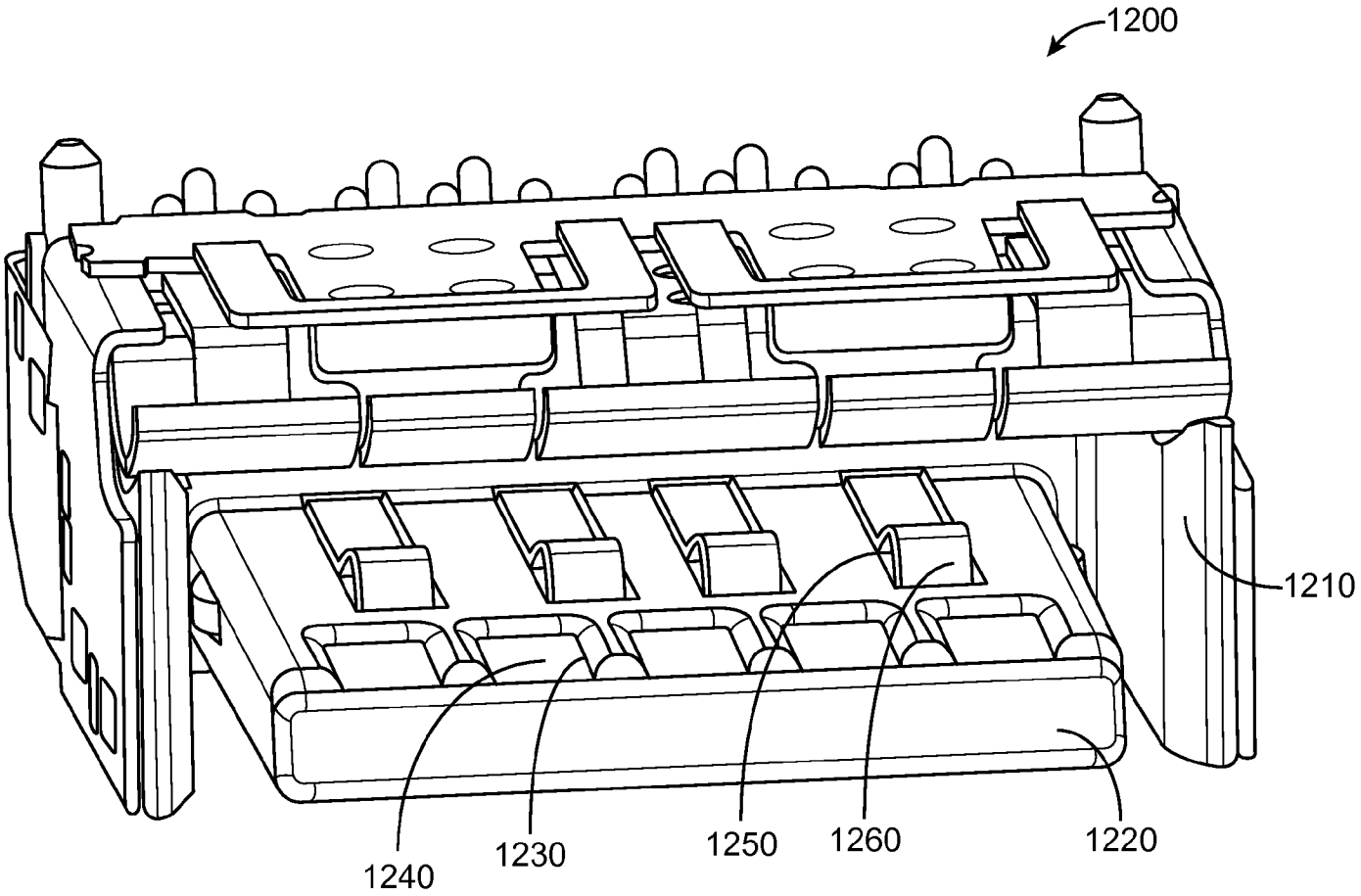
FIG. 13 illustrates another view of a connector receptacle according to an embodiment of the present invention.

FIG. 13 illustrates another view of a connector receptacle according to an embodiment of the present invention. Connector receptacle 1200 may include housing 1210 having tongue 1220. Tongue 1220 may include a first number of openings 1230 for a first number of contacts 1240 and a second number of openings 1250 for a second number of contacts 1260.

Figure 14:
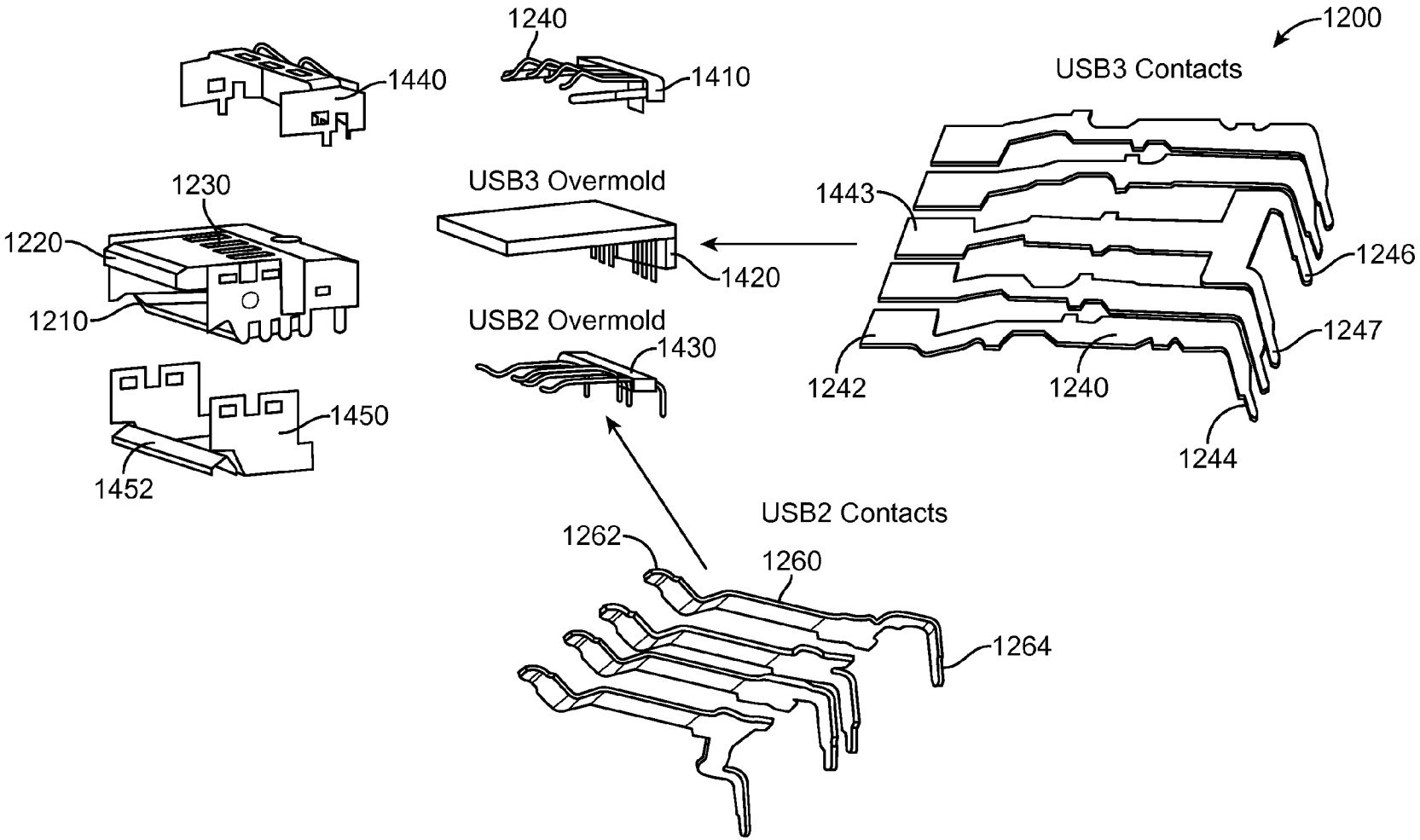
FIG. 14 is an exploded view of a connector receptacle according to an embodiment of the present invention.

FIG. 14 is an exploded view of a connector receptacle according to an embodiment of the present invention. Connector receptacle 1400 may include a first number of contacts 1240 held together by a first overmold portion 1420, and a second number of contacts 1260 held together by a second overmold portion 1430. A first overmold portion 1420 and second overmold portion 1430 may be attached to each other to form a subassembly that may be inserted into tongue 1220 of housing 1210. Tongue 1220 may include topside openings 1230. Shield portions 1450 and 1440 may be attached to housing 1210 for shielding and mechanical support.

Figure 15:
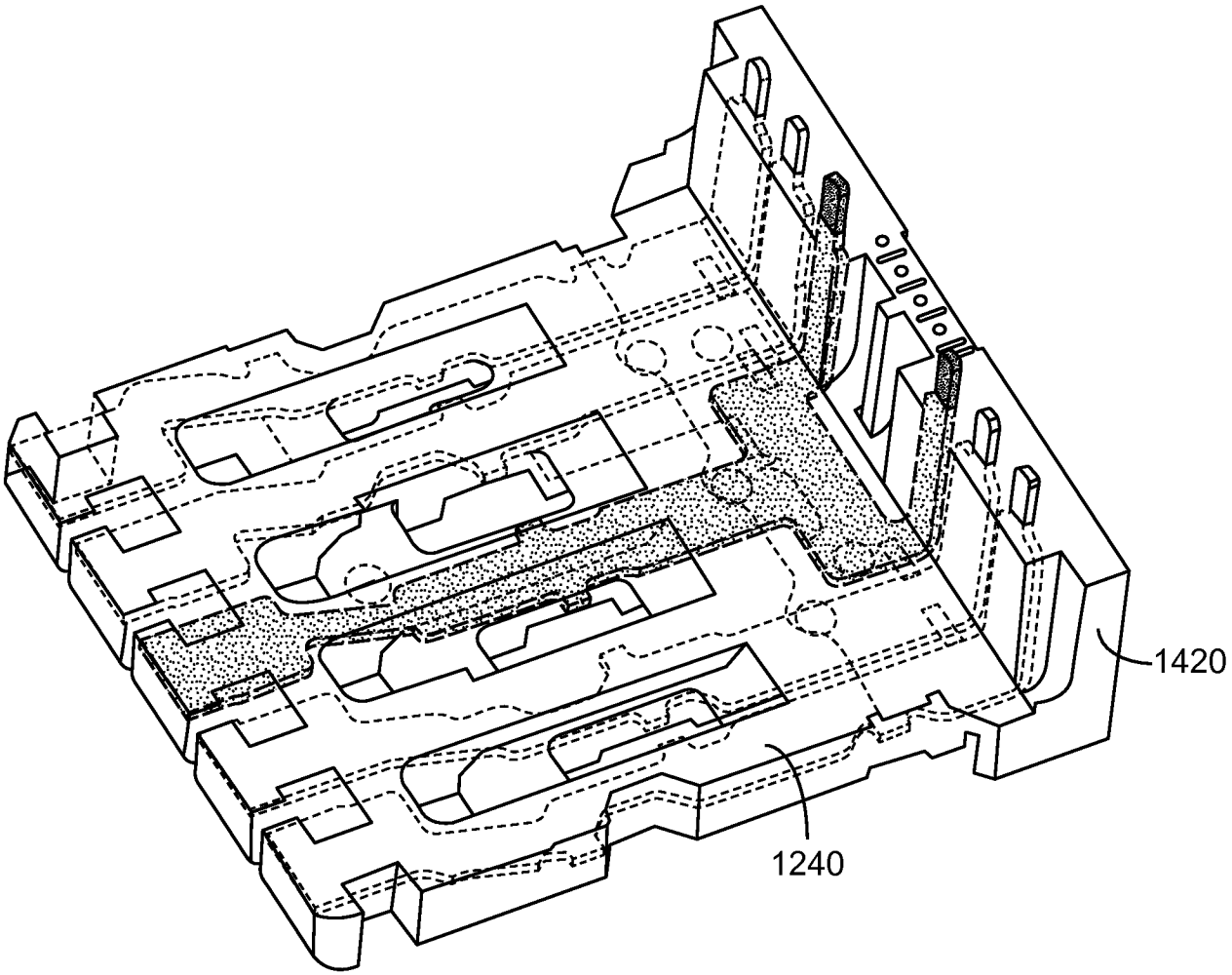
FIG. 15 illustrates a first overmold portion according to an embodiment of the present invention.

FIG. 15 illustrates a first overmold portion according to an embodiment of the present invention. In this example, a first overmold portion 1420 includes a number of contacts 1240.

Figure 16:
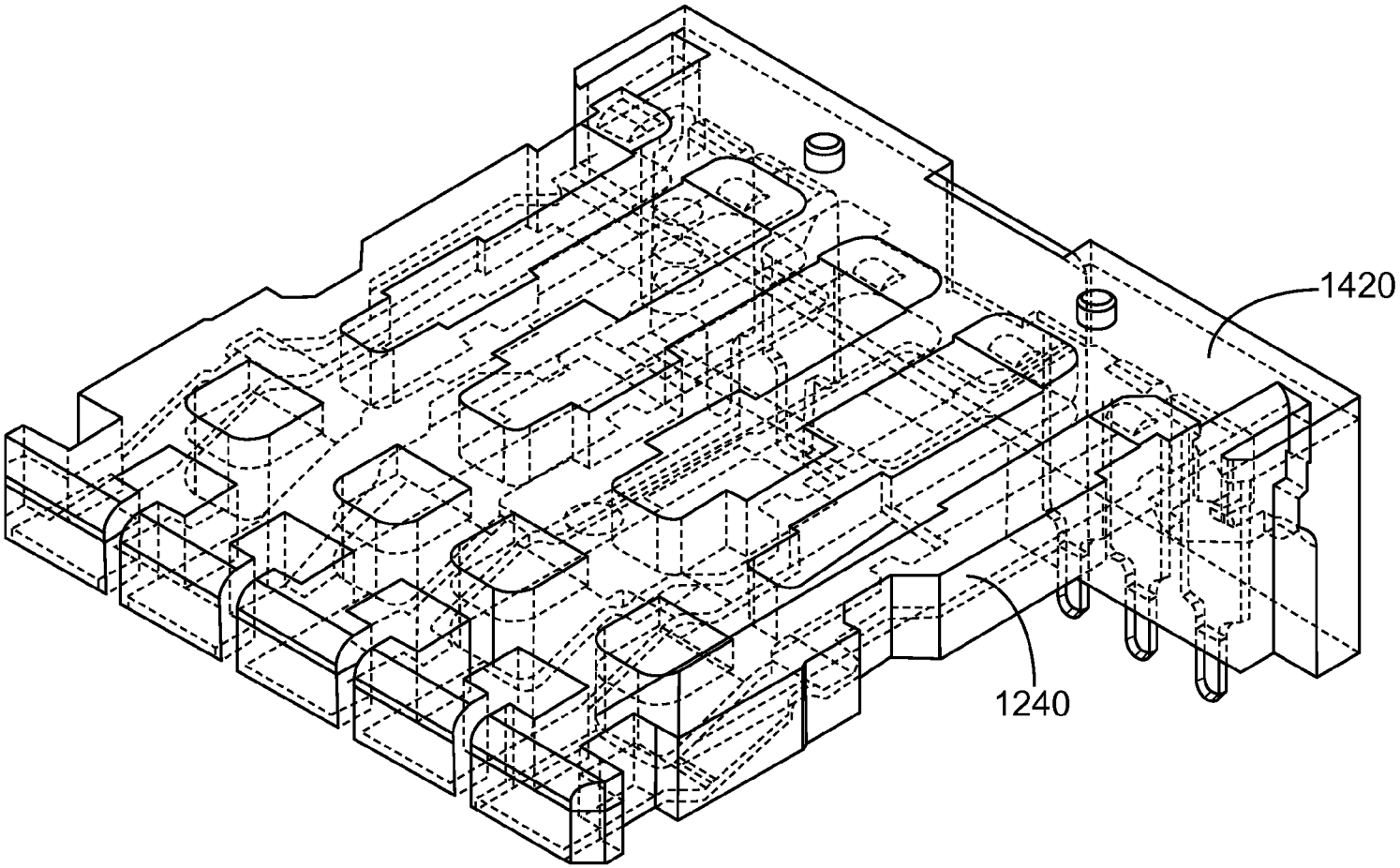
FIG. 16 illustrates another view of a first overmold according to an embodiment of the present invention.

FIG. 16 illustrates another view of a first overmold according to an embodiment of the present invention. Again, first overmold 1420 may include contacts 1240.

Figure 17:
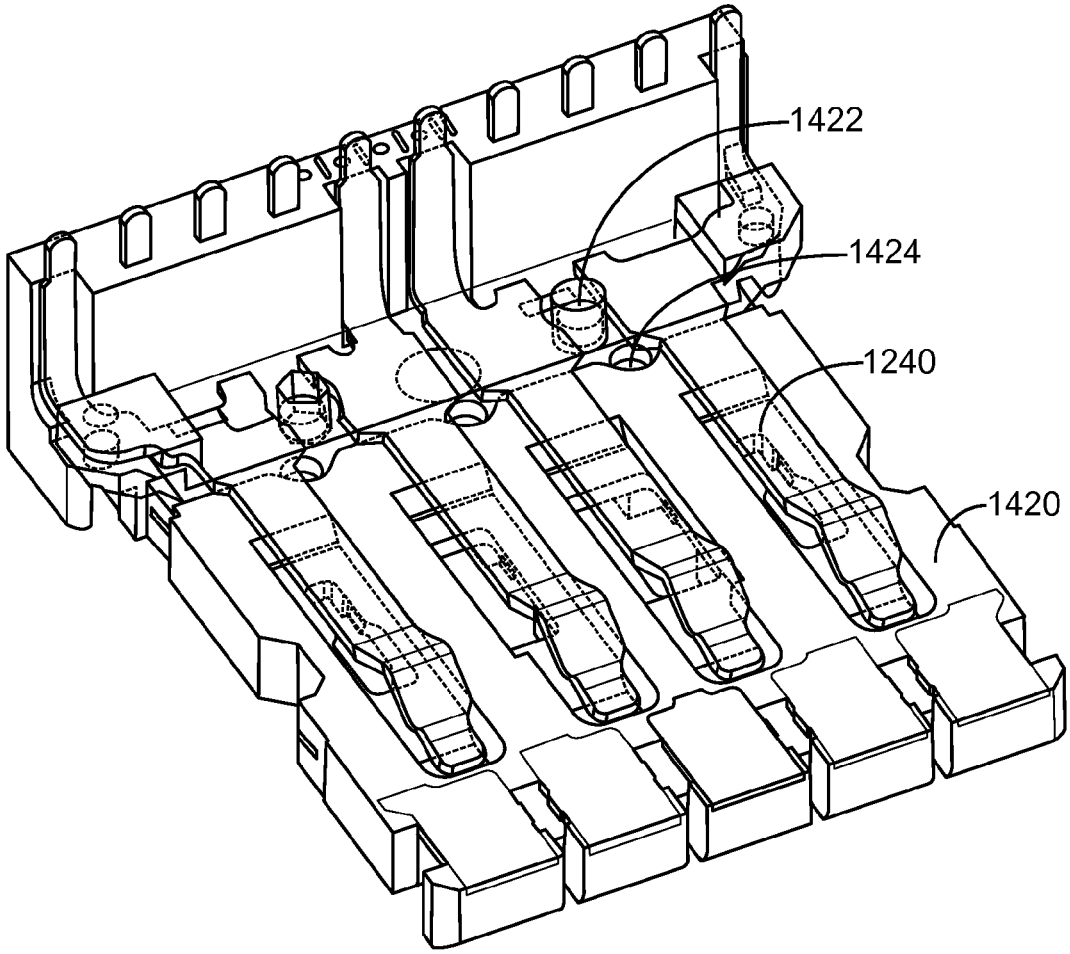
FIG. 17 illustrates another view of a first overmold according to an embodiment of the present invention.

FIG. 17 illustrates another view of a first overmold according to an embodiment of the present invention. Again overmold 1420 may include contacts 1240. Overmold 1420 may include posts 1422 and holes 1424 that accept corresponding holes and posts on a second overmold, though in other embodiments, only posts may be included on one overmold while holes are included on the other. In this way, a first overmold and a second overmold may be attached. Once the first overmold and second overmold are attached, they may be inserted into tongue 1220. An example is shown in the following figure.

Figure 18:
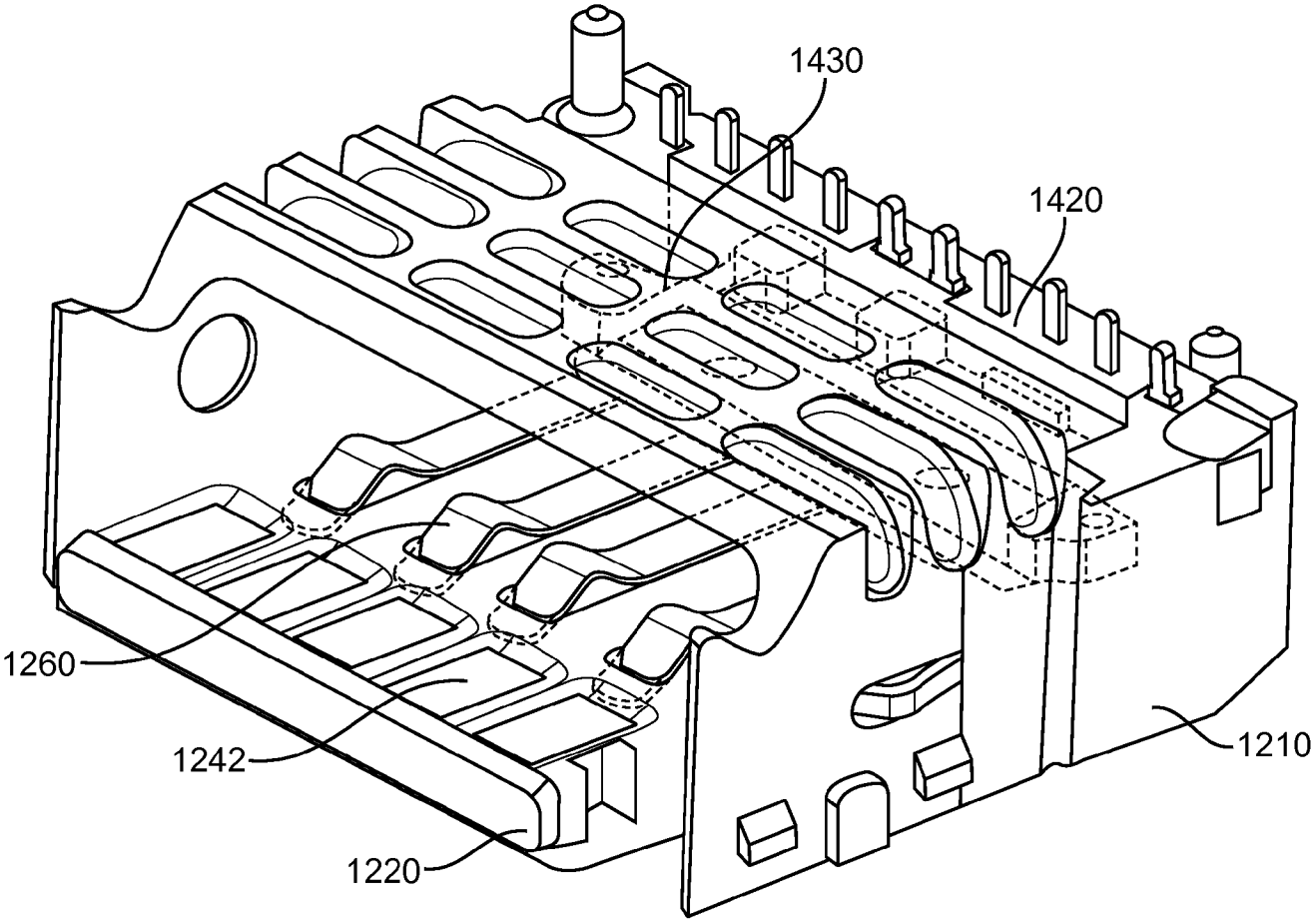
FIG. 18 illustrates a portion of a connector receptacle according to an embodiment of the present invention.

FIG. 18 illustrates a portion of a connector receptacle according to an embodiment of the present invention. In this example, a subassembly including first overmold 1420 and second overmold 1430 has been inserted into tongue 1220 of housing 1210. First overmold 1240 may include contacts 1242, while second overmold 1430 may include contacts 1260. Again, first overmold 1420 and second overmold 1430 may be attached and inserted into tongue 1220.

Figure 19:
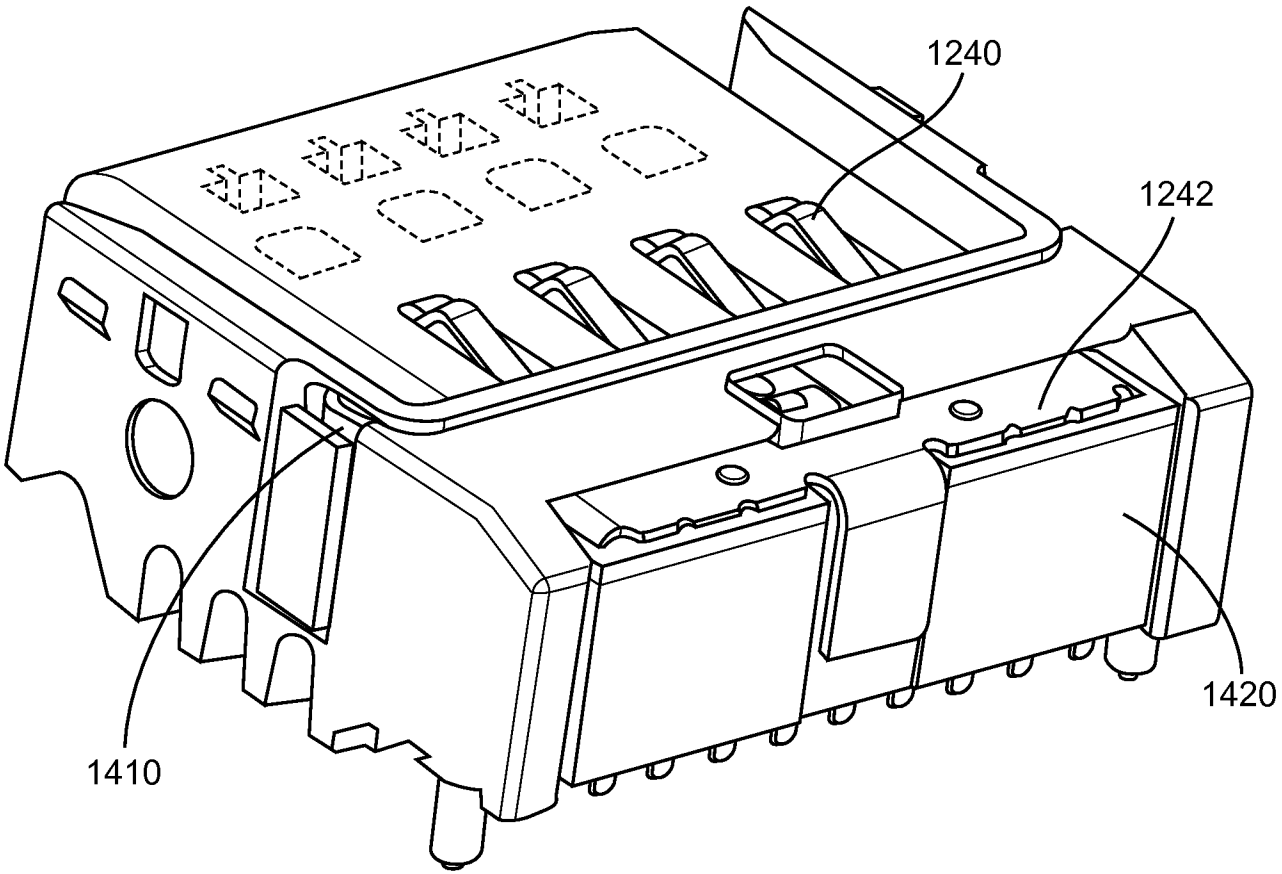
FIG. 19 illustrates another view of a portion of a connector receptacle according to an embodiment of the present invention.

FIG. 19 illustrates another view of a portion of a connector receptacle according to an embodiment of the present invention. In this example, ground contacts 1240 may be joined together by piece 1242, which may be attached to first overmold 1420. Side ground contacts 1410 may also be included.

Figure 20:
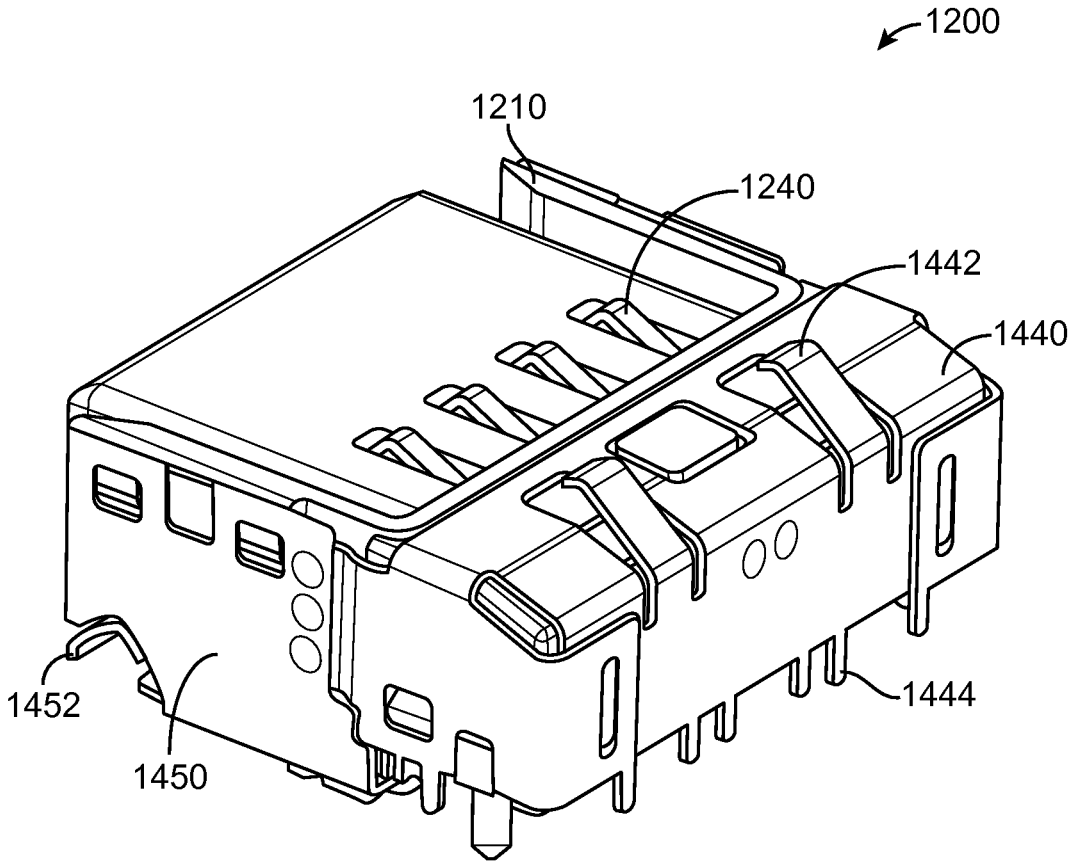
FIG. 20 illustrates a rear view of a connector receptacle according to an embodiment of the present invention.

FIG. 20 illustrates a rear view of a connector receptacle according to an embodiment of the present invention. In this example, a top of housing 1210 is absent. To compensate for a resulting loss of mechanical retention grounding, ground contacts 1240 may be included. Shield pieces 1450 and 1440 may also be included. Shield piece 1440 may include fingers 1442, which may contact a device enclosure or other component associated with a device enclosure. Tabs 1444 may be soldered or otherwise connected to a flexible circuit board, printed circuit board, or other appropriate substrate. Portion 1452 of shield 1450 may be used for grounding and mechanical retention.

Figure 21:
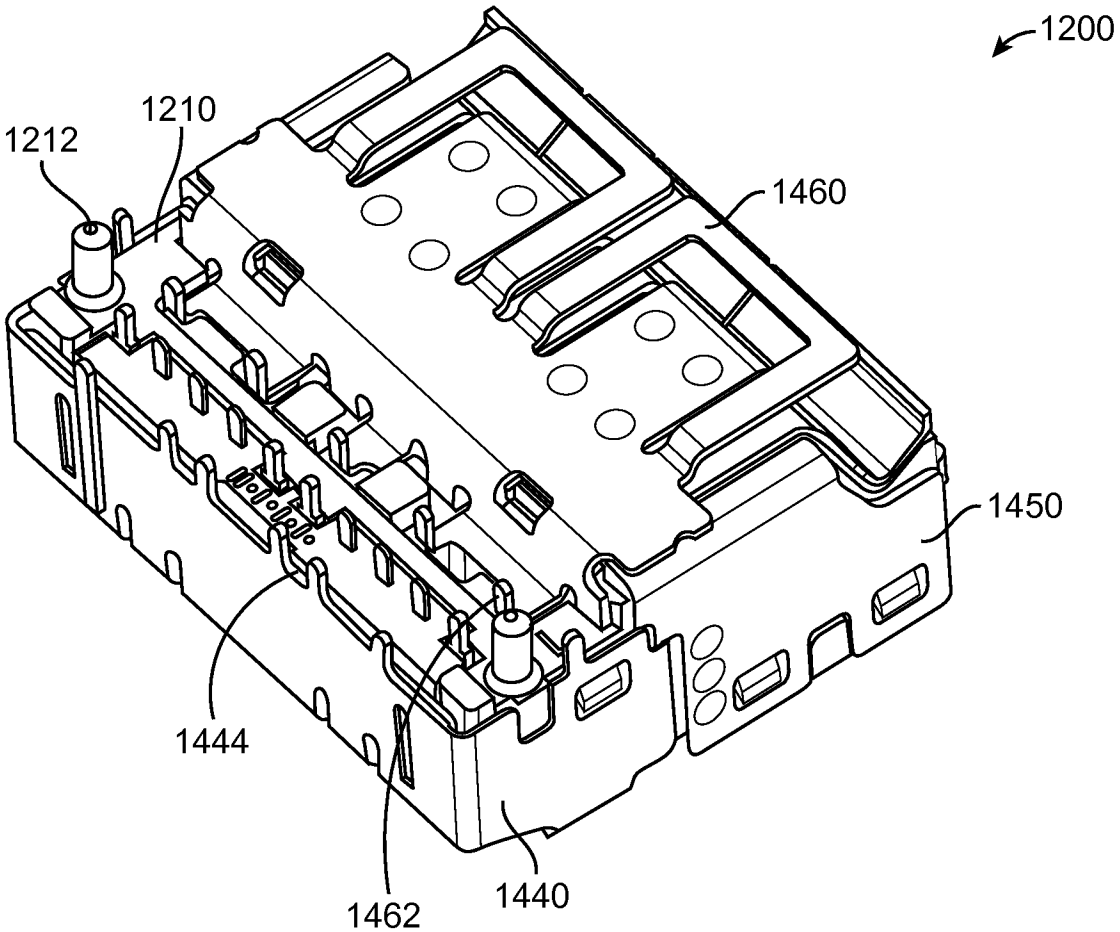
FIG. 21 illustrates another view of a connector receptacle according to an embodiment of the present invention.

FIG. 21 illustrates another view of a connector receptacle according to an embodiment of the present invention. In this example, an additional bottom piece 1460 may be added to shield 1450 to provide additional grounding. For example, tabs 1462, which may be part of shield portion 1460 and 1444, which may be part of shield portion 14490, may be grounded, thereby providing further shielding for the first, second, and third differential pairs. Post 1212 of housing 1210 may be used for further mechanical support.

Again, this and other embodiments of the present invention may provide shielding for the differential pairs as shown in the examples above. Similarly, this, and other embodiments the present invention, may employ through-hole contacting portions to reduce space consumed by the connector receptacle, though in other embodiments of the present invention, other types of contacting portions, such as surface-mount contacting portions, may be used.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A method of assembling a connector receptacle comprising:

assembling a subassembly by:

receiving a first plurality of contacts, each having a contacting portion at a first end and a through-hole portion at an opposite end, the first plurality of contacts including a first contact further having a second through-hole portions at the opposite end;

insert molding the first plurality of contacts to form an overmold portion; and attaching a second plurality of contacts to the overmold portion, each of the second plurality of contacts having a contacting portion at a first end and a through-hole portion at an opposite end;

receiving a connector receptacle housing, the connector receptacle housing having a tongue, the tongue being substantially hollow;

inserting an end of the first overmold portion, the contacting portions of the first plurality of contacts, and the contacting portions of the second plurality of contacts of the subassembly, a first ground contact, and a second ground contact in a back opening in a back of the tongue; and aligning the first ground contact with a first edge opening on a first edge of the tongue and the second ground contact with a second edge opening on a second edge of the tongue.

2. The method of claim 1 further comprising:

aligning the contacting portion of each of the first plurality of contacts with an opening in a first plurality of openings in a bottom of the tongue; and aligning the contacting portion of each of the second plurality of contacts with an opening in a second plurality of openings in the bottom of the tongue.

3. The method of claim 2 wherein the first plurality of openings are between the second plurality of openings and a front of the tongue.

4. The method of claim 3 wherein the through-hole portions of the first and second plurality of contacts are substantially in a line.

5. The method of claim 4 further comprising attaching a first shield portion around a bottom and sides of the connector receptacle.

6. The method of claim 5 further comprising attaching a second shield portion around a top and sides of the connector receptacle.

7. The method of claim 6 further comprising attaching a bottom piece to cover a bottom portion of the connector receptacle.

8. The method of claim 4 wherein the connector receptacle is a Universal Serial Bus 3 compatible connector receptacle.

9. A connector receptacle comprising:

a connector receptacle housing, the connector receptacle housing having a tongue, the tongue being substantially hollow;

a subassembly at least partially located in the hollow tongue, the subassembly comprising:

a first plurality of contacts, each having a contacting portion at a first end and a through-hole portion at an opposite end, the first plurality of contacts including a first contact further having a second through-hole portions at the opposite end;

an insert molded housing around at least a portion of the first plurality of contacts, the insert molded housing extending the length of the contacting portion of the first contact in the first plurality of contacts; and a second plurality of contacts attached to the insert molded housing, each having a contacting portion at a first end and a through-hole portion at an opposite end;

a first ground contact aligned with a first edge opening on a first edge of the tongue; and a second ground contact aligned with a second edge opening on a second edge of the tongue.

10. The connector receptacle of claim 9 wherein the tongue comprises a first plurality of openings on a bottom side of the tongue to provide access to the first plurality of contacts and a second plurality of openings on a bottom side of the tongue to provide access to the second plurality of contacts.

11. The connector receptacle of claim 10 wherein the first plurality of openings are between the second plurality of openings and a front of the tongue.

12. The connector receptacle of claim 11 wherein the through-hole portions of the first and second plurality of contacts are substantially in a line.

13. The connector receptacle of claim 12 further comprising a first shield portion around a bottom and sides of the connector receptacle.

14. The connector receptacle of claim 13 further comprising a second shield portion around a top and sides of the connector receptacle.

15. The connector receptacle of claim 14 further comprising a bottom piece to cover a bottom portion of the connector receptacle.

16. The connector receptacle of claim 12 wherein the connector receptacle is a Universal Serial Bus 3 compatible connector receptacle.

17. A method of assembling a connector receptacle comprising:

assembling a subassembly by:

receiving a first plurality of contacts, each having a contacting portion at a first end and a through-hole portion at an opposite end, the first plurality of contacts including a first contact further having a second through-hole portions at the opposite end;

insert molding the first plurality of contacts to form a first overmold portion, the first overmold portion extending the length of the contacting portion of the first contact in the first plurality of contacts;

receiving a second plurality of contacts, each having a contacting portion at a first end and a through-hole portion at an opposite end;

insert molding the second plurality of contacts to form a second overmold portion; and attaching the second overmold portion to the first overmold portion; and receiving a connector receptacle housing, the connector receptacle housing having a tongue, the tongue being substantially hollow;

inserting at least a portion of the subassembly, a first ground contact, and a second ground contact in a back opening in a back of the tongue; and aligning the first ground contact with a first edge opening on a first edge of the tongue and the second ground contact with a second edge opening on a second edge of the tongue.

18. The method of claim 17 further comprising:

aligning the contacting portion of each of the first plurality of contacts with an opening in a first plurality of openings in a bottom of the tongue; and aligning the contacting portion of each of the second plurality of contacts with an opening in a second plurality of openings in the bottom of the tongue.

19. The method of claim 18 wherein the first plurality of openings are between the second plurality of openings and a front of the tongue.

20. The method of claim 19 wherein the through-hole portions of the first and second plurality of contacts are substantially in a line.

21. The method of claim 20 further comprising attaching a first shield portion around a bottom and sides of the connector receptacle.

22. The method of claim 21 further comprising attaching a second shield portion around a top and sides of the connector receptacle.

23. The method of claim 20 wherein the connector receptacle is a Universal Serial Bus 3 compatible connector receptacle.

24. A connector receptacle comprising:

a connector receptacle housing, the connector receptacle housing having a tongue, the tongue being substantially hollow;

a subassembly at least partially located in the hollow tongue, the subassembly comprising:

a first plurality of contacts, each having a contacting portion at a first end and a through-hole portion at an opposite end, the first plurality of contacts including a first contact further having a second through-hole portions at the opposite end;

a first overmold around at least a portion of the first plurality of contacts;

a second plurality of contacts, each having a contacting portion at a first end and a through-hole portion at an opposite end; and a second overmold around at least a portion of the second plurality of contacts, the second overmold attached to the first overmold;

a first ground contact aligned with a first edge opening on a first edge of the tongue; and a second ground contact aligned with a second edge opening on a second edge of the tongue, wherein an end of the first overmold portion, the contacting portions of the first plurality of contacts, and the contacting portions of the second plurality of contacts are located in the hollow tongue.

25. The connector receptacle of claim 24 wherein the tongue comprises a first plurality of openings on a bottom side of the tongue to provide access to the first plurality of contacts and a second plurality of openings on a bottom side of the tongue to provide access to the second plurality of contacts.

26. The connector receptacle of claim 25 wherein the first plurality of openings are between the second plurality of openings and a front of the tongue.

27. The connector receptacle of claim 26 wherein the through-hole portions of the first and second plurality of contacts are substantially in a line.

28. The connector receptacle of claim 27 further comprising a first shield portion around a bottom and sides of the connector receptacle.

29. The connector receptacle of claim 28 further comprising a second shield portion around a top and sides of the connector receptacle.

30. The connector receptacle of claim 27 wherein the connector receptacle is a Universal Serial Bus 3 compatible connector receptacle.

* * * * *